US007356851B2

(12) United States Patent
Spruill

(10) Patent No.: US 7,356,851 B2
(45) Date of Patent: Apr. 15, 2008

(54) ATHLETIC SHIRT WITH TRIPLE GUSSETS

(76) Inventor: Gary Rayford Spruill, 1629 E. Cherokee, Enid, OK (US) 73701

( * ) Notice: Subject to any disclaimer, the term of this patent is extended or adjusted under 35 U.S.C. 154(b) by 33 days.

(21) Appl. No.: 11/433,805

(22) Filed: May 13, 2006

(65) Prior Publication Data

US 2007/0079419 A1 Apr. 12, 2007

Related U.S. Application Data

(60) Provisional application No. 60/724,372, filed on Oct. 8, 2005.

(51) Int. Cl.
*A41B 1/00* (2006.01)

(52) U.S. Cl. ..... 2/69; 2/53; 2/59; 2/77

(58) Field of Classification Search ..... 2/69, 2/53, 59, 77

See application file for complete search history.

(56) References Cited

U.S. PATENT DOCUMENTS

| | | | | |
|---|---|---|---|---|
| 4,698,849 | A * | 10/1987 | Mitchell et al. | 2/115 |
| 6,148,445 | A * | 11/2000 | Spruill | 2/125 |
| 2006/0048263 | A1 * | 3/2006 | Walsh | 2/69 |
| 2007/0028351 | A1 * | 2/2007 | Coolik | 2/115 |

* cited by examiner

*Primary Examiner*—Gary L. Welch
*Assistant Examiner*—Alissa Tompkins

(57) ABSTRACT

An athletic shirt which has triple gussets on each side providing an unparalleled range of motion and freedom. Each of the gussets have a specific function in the overall performance of the shirt. And, each gusset, of the present invention, is named in accordance with the particular group of muscles it provides unrestricted movement for. The gussets are named: 1.) Pectoralis major gusset; 2.) Serratus Anterior gusset; 3.) Latissimus dosi gusset.

6 Claims, 1 Drawing Sheet

ATHLETIC SHIRT WITH TRIPLE GUSSETS

CROSS REFERENCE TO RELATED APPLICATIONS

"This application is entitled to the benefit of Provisional Patent Application Ser. No. 60/724372 filed Oct. 8, 2005."

FIELD OF THE INVENTION

The present invention relates generally to athletic shirts with underarm gussets, and more specifically to an athletic shirt with triple underarm gussets providing a wearer with a greater range of motion and freedom than single underarm gussets. Wherein, an athletic shirt with triple underarm gussets is constructed out of moisture-wicking, high-performance stretchable fabric, and may be constructed as a compression fitting, (i.e., a shirt which fits tightly on the body of a wearer), shirt or a loose fitting shirt.

BACKGROUND OF THE INVENTION

The use of shirts with a single gusset under each arm is known in the prior art, and various methods of knitting, styles, and designs, of single underarm gussets have been manufactured in the apparel industry for several years.

Known shirts with single underarm gussets are witnessed by prior art: C. A. Brown, U.S. Pat. No. 243,498, Jun. 28, 1881; J. A. Scriven, U.S. Pat. No. 378,465, Feb. 28, 1888; L. Tim, U.S. Pat. No. 601,489, Mar. 29, 1898; L. L. Inman, U.S. Pat. No. 177952, Apr. 4, 1916; F. M. Evleth, U.S. Pat. No. 1,260,353, Mar. 26, 1918; F. Horak, U.S. Pat. No. 1,483,635, Feb. 12, 1924; C. F. Trageser, U.S. Pat. No. 1,973,419, Dec. 29, 1933; H. L. Redmond, U.S. Pat. No. 2,035,377, Mar. 24 1936; R. E. Blood, U.S. Pat. No. 2,104,288, Jan. 4, 1938; C. H. Martin, U.S. Pat. No. 2,171, 220, Aug. 29, 1939; H. B. Northrup, U.S. Pat. No. 2,434, 809, Jan. 20, 1948; R. E. Lee, U.S. Pat. No. 2,314,226, Jan. 12, 1942; H. S. Heilbronner, U.S. Pat. No. 2,456,190, Feb. 24, 1947; W. W. Artzt, U.S. Pat. No. 2,575,700, Jul. 22, 1950; E. L. Olrich, et al, U.S. Pat. No. 2,554,380, May 22, 1951; S. N. Friedland, et al, U.S. Pat. No. 2,613,360, Oct. 14, 1952; S. Rosenbaum, et al, U.S. Pat. No. 2,792,572, Nov. 15, 1954; H. S. Geiss, U.S. Pat. No. 2,836,826, Jun. 31, 958; H. S. Geiss, U.S. Pat. No. 2,839,756, Jun. 24,1958; E. M. Bren, U.S. Pat. No. 2,941,210, Apr. 21, 1958; H. L. Neuman, U.S. Pat. No. 3,037,210, Jun. 5, 1962; B. D. Huntley, U.S. Pat. No. 3,078,699, Feb. 26, 1963; B. Bindler, U.S. Pat. No. 3,137,860, Jun. 23, 1964.

Also, known in the prior art is Fairhurst, et al., U.S. Pat. No. 6,446,264, which is a close-fitting swimsuit with panels made of an elastic stretch fabric.

The present invention provides a novel shirt with underarms which have triple gussets, and the present invention provides a wearer with a shirt which has a greater range of motion and freedom to move arms and shoulders in every direction without restriction or binding of the fabric.

BRIEF SUMMARY

The primary disadvantage inherent in the known types of single underarm gussets now present in the prior art is that these single gussets only allow for a minimal amount of freedom in abducting the arm. These single underarm gussets prevent the fabric of the shirt from pulling tight across the deltoid and tri-cep muscles causing restriction of movement, and these single underarm gussets, by use of the extra fabric which make up the single gusset, prevent the underarm seam, where the sleeve is sewn to the body of the shirt, from digging or cutting into the armpit of a wearer causing discomfort when his arms are lifted overhead. Whereas, all known single gussets in the prior art primarily allow for only an extension abduction of the arm. Therefore, the single gussets in the prior art do not address the medial rotation or adduction of the human arm.

The primary disadvantage in the close-fitting swimwear invented by Fairhurst, et al., is it is designed to keep compression on the muscle groups wherein the seams acts as tendons.

Reviewing the disadvantages inherent in the known types of single underarm gussets now present in the prior art, The present invention provides for triple gussets under each arm wherein a wearer can move his arms and shoulders without any restriction due to each gusset of the triple gusset having a specific function. And, each gusset of the triple gusset are named after the specific muscle group which they provide freedom of movement for without restriction or binding of the fabric of the shirt. The names of the triple gussets are: the Pectoralis major gusset; the Serratus Anterior gusset; the Latissimus Dorsi gusset. And, the triple gussets function in the same synergistic manner as those muscle groups which they are named after because it rarely happens in the movement of the human body that just one particular muscle moves alone.

The Pectoralis Major, which are commonly known as pects, compliment the Latissimus Dorsi muscles. The Pects are responsible for moving the arm in flexion (lowering the arm as if you were swinging a hammer), and in adduction. The Pectoralis Major originate at the first six ribs and the midhalf of your clavicle (collarbone). The insertion point of this muscle is very close to the insertion point of the Latissimus Dorsi, with the exception it is on the outer edge of humerous's bicipital groove.

The Latissimus Dorsi, which are commonly known as lats, are huge muscles which originate along most of your spine, and the insertion is on your humerous (upper arm bone), right near the socket. This feature is called the bicipital groove's medial lip. The Lats are responsible for three distinct movements of the arm: extension, adduction, and medial rotation.

The Serratus Anterior muscles are located under your arms, just down from the armpit. The Serratus Anterior has a dual function. In addition to being an auxiliary breathing muscle, (i.e., aid inhalation by assisting expansion of the ribs when you are breathing strenuously), it also rotates the shoulder blade to position it for raising your arm. Without the serratus anterior, you wouldn't be able to raise your arm above shoulder level. Since the Serratus Anterior is so active, not only in strenuous breathing, but also in movements of the arm and shoulder, it's can be vulnerable to overuse in tennis, swimming, running, chin-ups, push-ups, weight lifting, and acrobatic exercises.

BRIEF DESCRIPTION OF THE DRAWINGS

The triple gussets of this invention will be described in more detail with reference to the accompanying drawings which illustrate a specific embodiment of the invention.

DETAILED DESCRIPTION OF THE DRAWINGS

Figure 1:
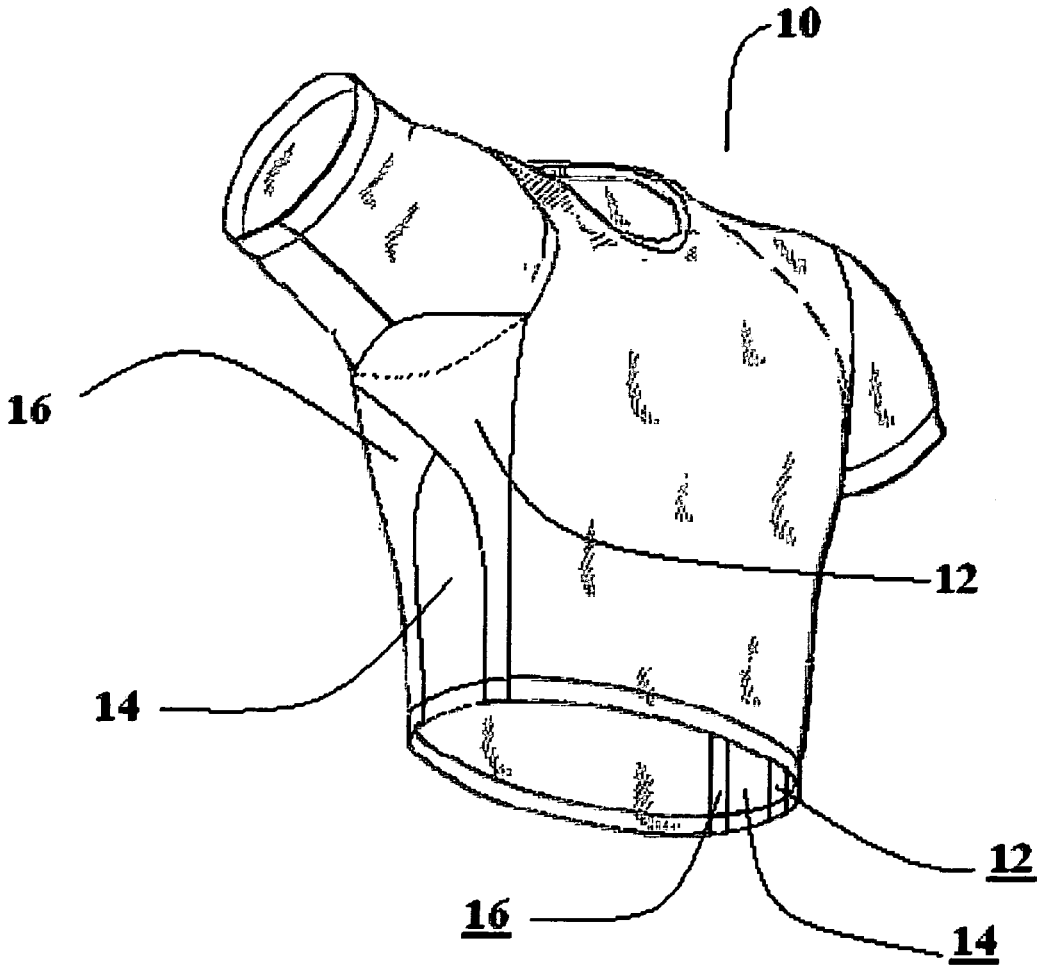
FIG. 1 is a perspective view of a shirt with the triple gussets of the present invention.

With reference to the accompanying drawings the same parts are identified by the same reference numeral in all figures of the drawings. In FIG. 1, a specific embodiment of the present invention is displayed. Wherein, a shirt having a front panel, a back panel, sleeves (either short or long), a collar, and a triple gusset, is generally indicated by numeral 10. Numerals 12, 14, and 16, indicate a triple gusset. The Pectoralis Major gusset is indicated by Numeral 12. The Serratus Anterior gusset is indicated by Numeral 14. The Latissimus Dorsi gusset is indicated by Numeral 16. Numerals 12, 14, and 16, (although displayed in FIG. 1 as seen from the inside of the shirt) indicate an identical corresponding triple gusset for the left side of shirt 10.

I claim:

1. An athletic shirt comprising: a body portion having a front panel with a chest area and a waist area made out of a moisture-wicking, fast-drying, stretchable, high-performance fabric, and a back panel which has shoulder blade areas and waist area made out of said fabric; sleeves made out said fabric permanently sewn to said body portion; a pair of identical triple gussets made out of said fabric wherein each triple gusset is permanently sewn and joins each side of said front panel to each side of said back panel and extends into the armpit sections of each sleeve joining said sleeves to said body portion and wherein each triple gusset consists of: a Pectoralis Major gusset (12) which is attached to the front panel at a side seam, and flares out at the chest area and covers the armpit area and connects to the back panel allowing for adduction and flexion of the arm of a wearer without restriction or binding of said fabric through the chest area or armpit area; a Latissimus Dorsi gusset (16) which is attached to the back panel at a side seam and flares out at the armpit area and the shoulder blade area and connects to the Pectoralis Major gusset (12) at the armpit area allowing for extension, adduction, and medial rotation of the arm without any restriction or binding of said fabric in the back panel of said shirt; a Serratus Anterior gusset (14) which is sandwiched between and connects to both the Pectoralis Major gusset (12) and the Latissimus Dorsi gusset (16) allowing for shoulder rotation of the arm and rib cage expansion without any restriction or binding of said fabric through the body portion; a collar.

2. The sleeves of claim 1, wherein said sleeves can be short or long, raglan style or set-in style.

3. The collar of claim 1, wherein said collar can be crew-neck, v-neck, turtle-neck, or button-up.

4. The body portion of claim 1, wherein said body portion can be loose-fit or compression fit.

5. The sleeves of claim 1 wherein said sleeves may be loose-fit or compression fit.

6. The pair of triple gussets of claim 1, wherein said pair of triple gussets may be loose-fit or compression fit.

* * * * *